US006338414B1

(12) United States Patent
Schellenbach

(10) Patent No.: US 6,338,414 B1
(45) Date of Patent: Jan. 15, 2002

(54) PLASTIC CLOSING CAP WITH A SEPARABLE SAFETY SEAL AND INNER SEAL

(75) Inventor: Frank Schellenbach, London (GB)

(73) Assignee: International Packaging Engineering (GB)

( * ) Notice: Subject to any disclaimer, the term of this patent is extended or adjusted under 35 U.S.C. 154(b) by 0 days.

(21) Appl. No.: 09/423,172

(22) PCT Filed: Mar. 3, 1999

(86) PCT No.: PCT/EP99/01357

§ 371 Date: Jan. 11, 2000

§ 102(e) Date: Jan. 11, 2000

(87) PCT Pub. No.: WO99/44896

PCT Pub. Date: Sep. 10, 1999

(30) Foreign Application Priority Data

Mar. 3, 1998 (DE) ..... 198 08 926

(51) Int. Cl.[7] ..... B65D 41/34

(52) U.S. Cl. ..... 215/252; 215/344; 215/354; 215/DIG. 1

(58) Field of Search ..... 215/252, 354, 215/352, 345, 344, 343, 341, DIG. 1, 256

(56) References Cited

U.S. PATENT DOCUMENTS 4,592,476 A * 6/1986 Yasada ..... 215/252
4,687,114 A * 8/1987 Crisci ..... 215/256
4,784,281 A * 11/1988 Rozenberg ..... 215/252
5,230,856 A * 7/1993 Schellenbach
5,782,369 A * 7/1998 Tansey ..... 215/252 X
5,803,281 A * 9/1998 Towns ..... 215/252 X
6,003,701 A * 12/1999 Hidding et al. ..... 215/252

FOREIGN PATENT DOCUMENTS

EP WO 93/24386 12/1993
NL 7612729 11/1976
WO 9602430 A1 * 2/1996

* cited by examiner

*Primary Examiner*—Nathan J. Newhouse
(74) *Attorney, Agent, or Firm*—Sam Silverberg

(57) ABSTRACT

The problem to be solved by the invention consists in the provision of a one-piece plastic enclosure, in particular made of PE-material, which can be placed on a filled container without satisfying particular tolerance requirements while simultaneously satisfying the additional, in part contradictory requirements, namely, to be manufactured in a few steps and to be apt for recycling after use, while ensuring reliably the guarantee function and the sealing function, for the closed container. The solution consists in a closure cap which has an extended guarantee band and an extended inner seal, i.e. a seal which projects about and along the edge of the container neck into the opening, which is characterized by a funnel- or bell-shaped prolongation at the free end of the guarantee band, a wedge- or funnel-shaped outer surface on the-extended inner seal, and an average standard solidity of the plastic material of the one-piece closure cap (in particular as to solidity of the PE-material) such, that the funnel-or bell-shaped guarantee prolongation sits on the supporting collar in a non-undergrippable manner and the funnel-shaped outer surface of the inner sealing rests elastically pressing on the container neck.

37 Claims, 8 Drawing Sheets

PLASTIC CLOSING CAP WITH A SEPARABLE SAFETY SEAL AND INNER SEAL

Figure 1:
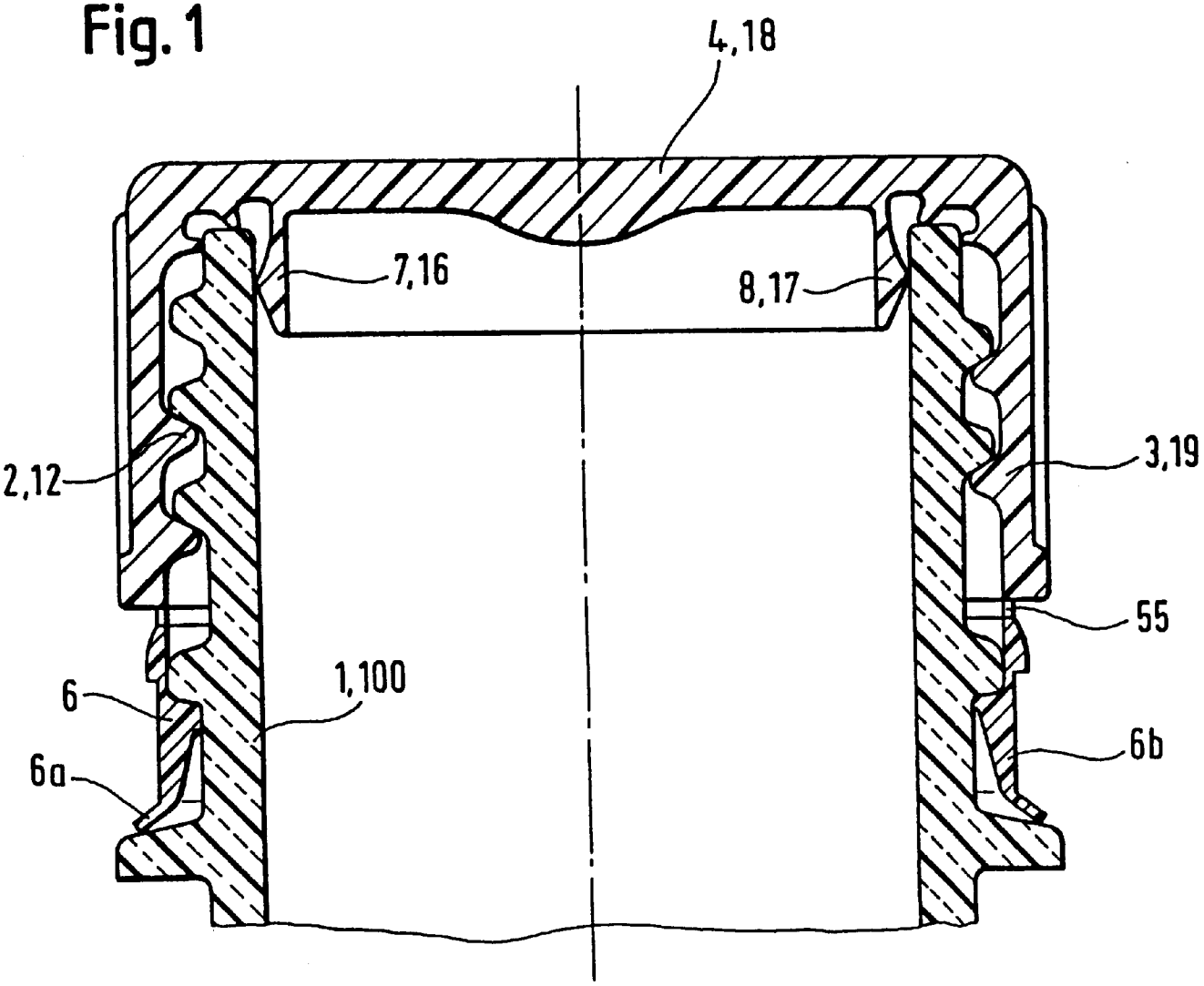

Closure caps made of plastic material for closing containers, in particular bottles, are largely used in accordance with the state of the art. Many types of embodiment of closure caps are provided with an annular guarantee band which is detachable and torn off from the closure cap when opening the bottle. As long as the annular guarantee band in its intact state is connected to the very closure cap via small links it indicates the original state of the contents of the bottle. Thus, it is guaranteed that the closure cap is fixed on the bottle neck in its original state, preferably screwed there upon.

To this effect the guarantee band, subsequently to the filling and closing of the container, is gripping around and beneath a bead or projection of the bottle neck. When the closure cap is opened the links extending between the side wall of the closure cap and the guarantee band are disrupted by the tensile and the shearing forces. The guarantee band rests on the bottle neck and the closure cap can be unscrewed completely.

At present, polypropylene (PP) is mostly used as a plastic material for the body of the closure cap. The plastic material PP is relatively hard so that the function of the guarantee band is safely ensured. It is almost impossible to lever up the PP-closure cap by means of a tool without visibly damaging it.

Since the sorting means of the filling installation can process only a uniform range of heights of the closure caps without readjustment, the height is fixed uniformly to about 20 mm. The guarantee band rests firmly fixed on the bottle neck and is torn off immediately when attempting to open the bottle.

Beneath the bead or projection which is gripped from beneath of its bottom side by the detachable guarantee band, there is also provided a supporting collar. The bottle is conventionally suspended on this supporting collar while it is being filled and closed thereafter. In this case the bottles are formed particularly of the plastic material PET or PEN. The annular guarantee band of the closure cap, with the here addressed and conventionally used PP-embodiment of the state of the art, ends at a distance of approximately 2 mm above the supporting collar on the bottle neck.

The disadvantage of the known closure cap consists in the fact that it must be manufactured in two parts. Polypropylene would be too hard a material for forming sealing lips which tighten the space existing between the bottle neck and the closure cap. This is particularly critical with PET-bottles which can be afflicted by greater unevennesses and deformations than glass bottles. The softer sealing is made for example of ethylene vinyl acetate (EVA), i.e. two different steps of injection molding as well as a subsequent step of assembling the two-piece closure cap are needed.

In order to avoid this drawback, one-piece closure caps made of polyethylene (PE) have already been proposed: This kind of material is softer than the usual polypropylene and can therefore safely ensure the tightening function by shaping the sealing system, when the closure cap is manufactured in one piece by a sole step of injection molding.

On the other hand, when applying the softer PE-material, there is the risk that the guarantee band can be detached by a fraud and that integrity is feigned. Therefore, the one-piece plastic closure cap made of PE has not made its way until now because of the problem of ensuring guarantee.

For this reason there is a need for a one-piece plastic closure cap, the guarantee function of which ensures more security than before.

From the U.S. Pat. No. 4,592,476 there is known a plastic closure cap in accordance with the preliminary part of patent claim 1, wherein the removable guarantee band is extended in the direction of the central axis of the closure cap. According to the U.S. patent specification the guarantee band extends up to the supporting collar of the container when the closure cap sits on the opening of the container and the guarantee-band grips beneath the bead or projection on the bottle neck.

From the European patent application EP 536 082 there is known a closure cap which is made in one piece together with the guarantee band by injection molding. Connecting elements are disposed between the closure cap and the guarantee band. On the bottom of the cap cover there is provided an inner sealing.

From the European patent application EP 316 167 there is known the combination of a bottle and a closure cap. The bottle consists of polyethyleneter ephtalate (PET). The closure cap is formed of a thermoplastic resin like polyolephine for example. The closure cap has an annular shoulder 10 which rests on the upper and outer surface of the bottle neck. In addition, the closure cap has an annular rib 13 which (inwardly from the shoulder 10) rests elastically on the inner surface of the bottle neck.

From the international application WO 93/24386 there is known a closure cap for multi-way-PET-bottles provided with a cap wall having an inner thread, a front wall closing the cap wall, and a guarantee band connecting to the cap wall. The front wall has a circular inner sealing spaced apart from the cap wall and projecting downwardly to the open end of the cap, with the outer diameter of the sealing tapering in the region of the free end towards the latter. For gas tight use the closure cap is configured such that the inner sealing has a bead in the region of the free end which is directed to the cap wall and such that the bead encloses the region which tapers in respect of its outer diameter.

Finally, a closure cap for releasable closing of a container is known from the international application WO96/02430 which comprises a cap body that corresponds to the container. The cap body and a seal cooperate with the upper edge of the container for closing the container. The closure cap comprises at least one shoulder formed on the cap body which shoulder extends opposite to the upper edge and cooperates in the closing phase with the sealing.

In addition to reliably ensuring the guarantee function and the sealing function it is desirable not to impose particular requirements on behalf of such closure caps as to tolerances. It is also desirable that the closure cap can be manufactured, i.e. formed in and deformed from a mould in few steps and that it is capable for being recycled after use.

The problem to be solved by the invention consists therefore in the provision of a one-piece plastic enclosure, in particular made of PE-material, which can be placed on a filled container without satisfying particular tolerance requirements while simultaneously satisfying the additional, in part contradictory requirements, namely to be manufactured in a few steps and to be apt for recycling after use, while ensuring the guarantee function and the sealing function.

In accordance with the present combinational invention, the solution consists in the provision of a closure cap which has an extended closure guarantee band and an extended inner seal, i.e. a sealing which projects about and along the edge of the container neck into the opening, which cap is characterized in combination by:

a funnel- or bell-shaped prolongation at the free end of the guarantee band, a wedge-shaped outer surface on the extended inner seal, and an average standard solidity of the plastic material of the one-piece closure cap (in particular as to the PE-material) such that the funnel- or bell-shaped guarantee prolongation sits on the supporting collar of the container in a non-undergrippable manner and the wedge-shaped outer surface of the inner seal rests on the container neck in a pressing manner.

Because of the funnel-shaped extension on the guarantee band and the wedge- or funnel-shaped outer surface on the inner sealing, the plastic closure can be placed on a filled container without particular tolerance requirements. Because of forming the cap in one piece, the plastic closure can be formed and taken out (deformed from) of the mould in a few steps. Because of the same feature (only one type of plastic material), the plastic closure cap allows for being recycled after use. The guarantee function for the closed container is reliably ensured by the fact that the funnel- or bell-shaped prolongation of the guarantee band sits on the supporting collar of the filled container. The tightening function for the closed container is reliably ensured by the fact that the wedge- or funnel-shaped outer surface of the inner seal rests on the container neck. The plastic material has, when used, a solidity which is hard enough for complying with the funnel-shaped guarantee band and at the same time soft enough for complying with the extended wedge-shaped inner sealing. The undercuts at the guarantee band and at the inner sealing can be removed from the mould as long as the warm plastic material has not yet reached its full strength or solidity needed for use.

Further features of the invention are characterized in the sub-claims. According to patent claim 4 the guarantee band can be longer in the direction of the central axis of the closure cap than the usually applied 20 mm. In particular, a total height of 23.5 mm is suited for closing PET-bottles being in use nowadays. In using these lengths the guarantee band extends down to the supporting collar and is tightly pressed upon it. The lower end of the guarantee band can sit thereupon similar to a bell so that it cannot be gripped from below, and it offers sufficient security too, although the relatively smooth PE-material is used.

A one-piece structure of the entire closure cap is obtained (patent claim 2). The preferred material polyethylene (PE) used under these circumstances is characterized in patent claim 3.

It is of importance to adjust all of the functions of the closure cap to the shape and to the material of the container to be closed. In the preferred example or embodiment, the container is a bottle (patent claim 6) which is provided with a screw-type cap. The bottle is made preferably of plastic material (patent claim 7). At present, PET-bottles, but also PEN-bottles are conventionally used and wide-spread (patent claim 8), with the claimed plastic closure caps being particularly well suited. Nonetheless, the preferred examples of embodiment concerning the structure and the use of the closure caps are not meant to restrict the invention formulated in the patent claim 1.

In the sub-claims 9 to 23 or dependent claims, a sealing system "a" combined with the extended guarantee band is claimed. In the sub-claims 24 to 35, a sealing system "b" in combination with the extended guarantee band is the object. The sub-claim 36 relates to a scaly structure at the rear side of a thin, wedge-shaped sealing lip.

Figure 1A:
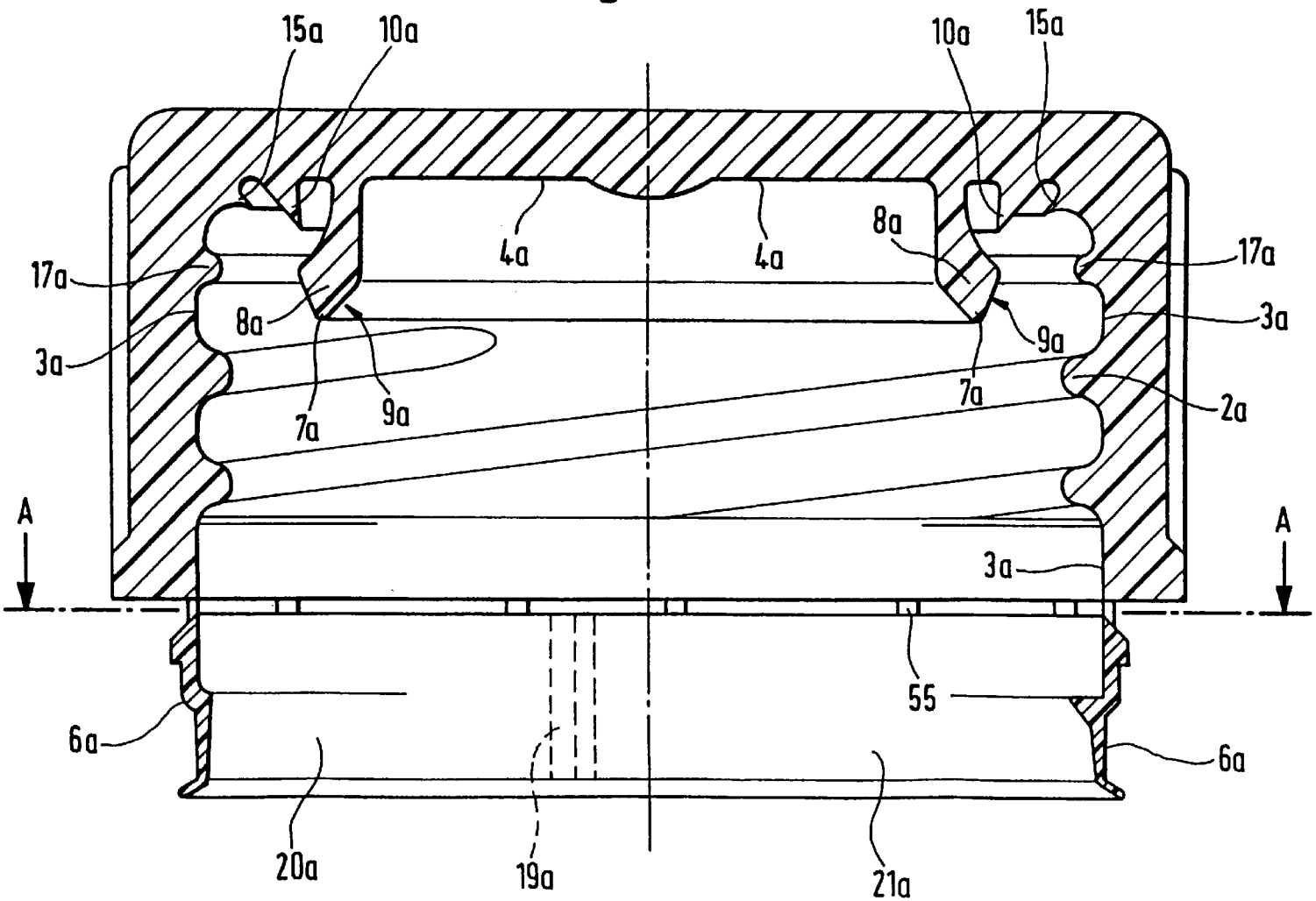
Figure 2A:
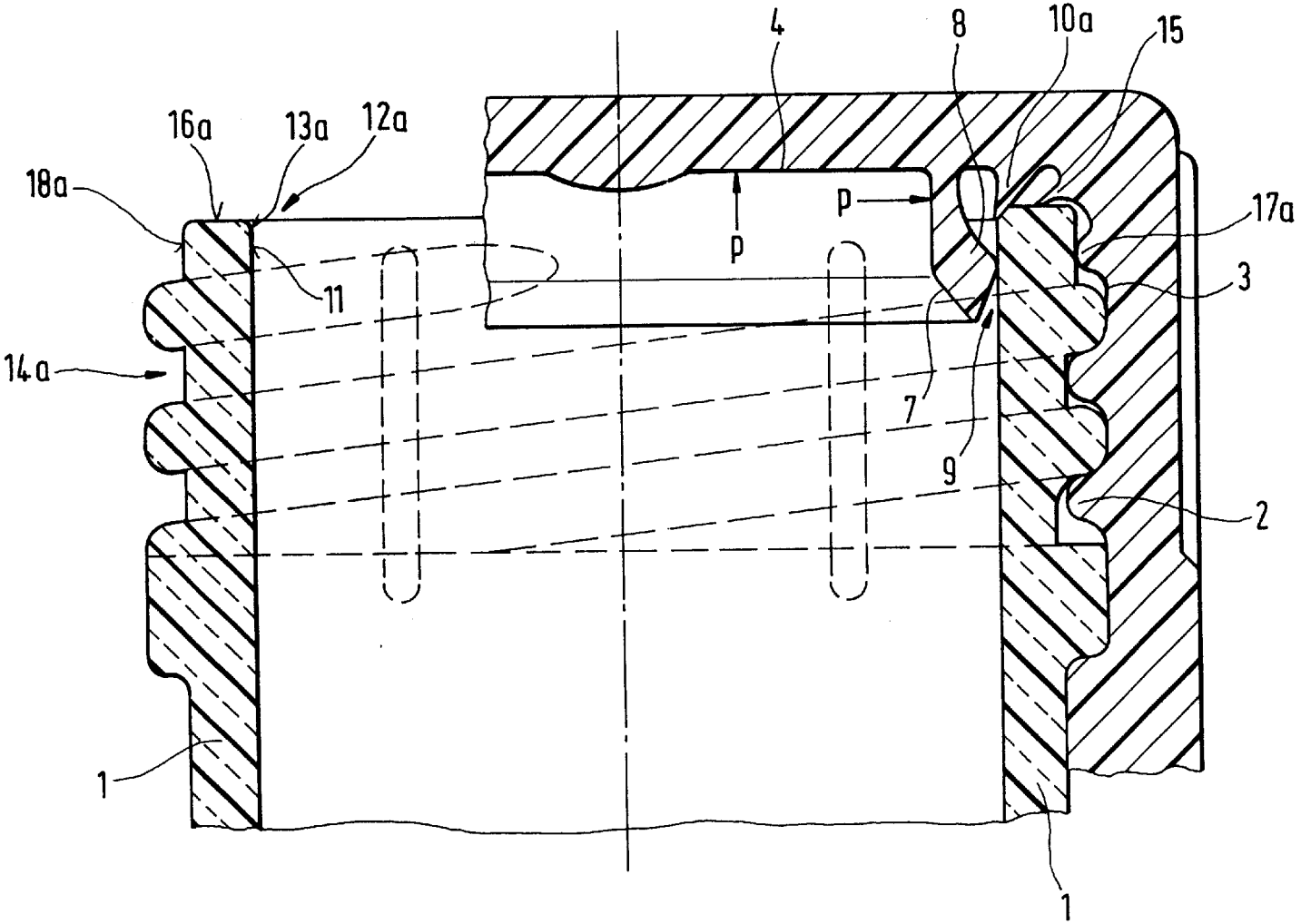
Figure 3A:
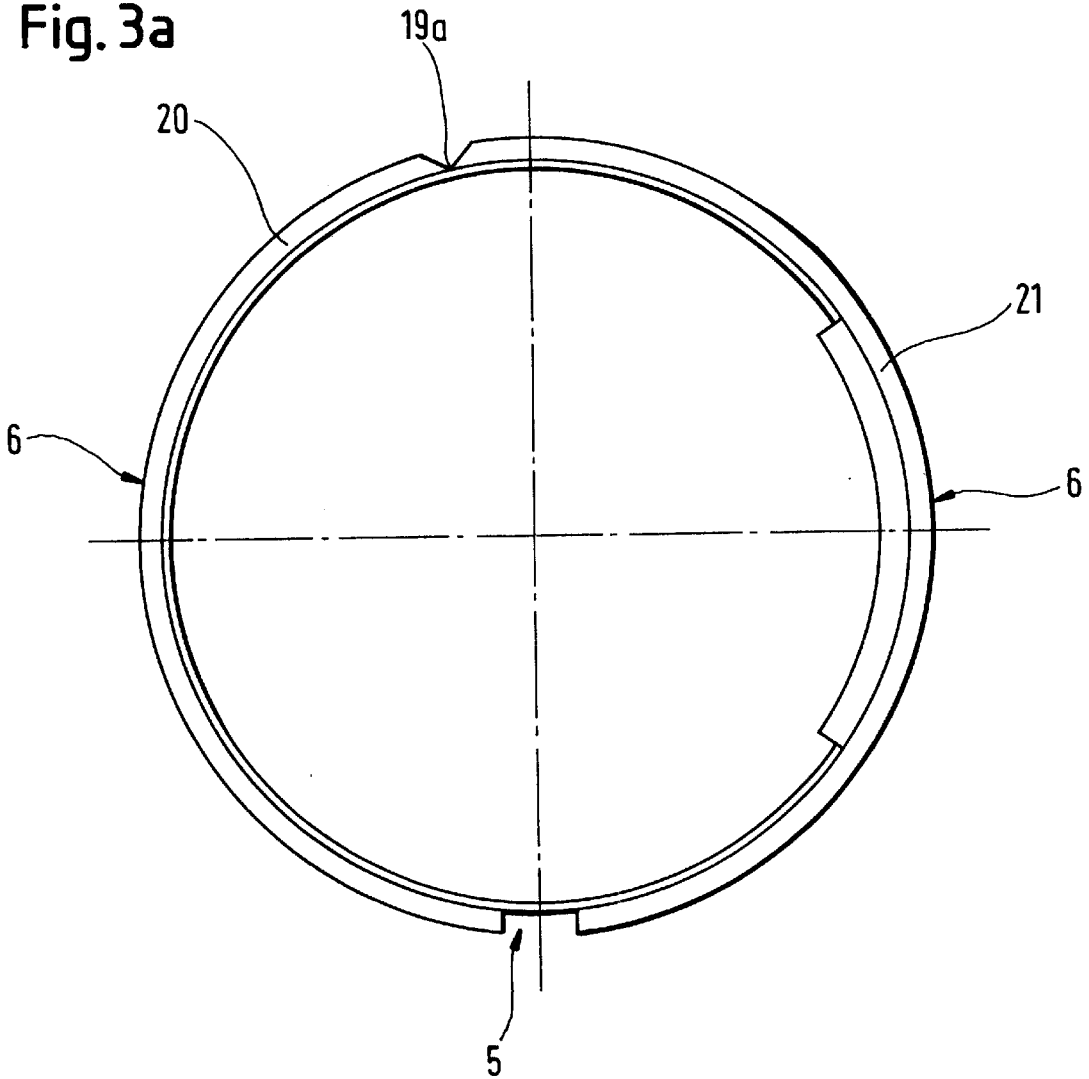

The combinational invention is now explained hereafter in more detail by means of FIGS. 1–4 which depict in:

FIG. 1: The basic principle of a closure cap in accordance with the invention comprising an extended guarantee band and an extended inner seal;

FIGS. 1*a*, 2*a*, 3*a*: An example of embodiment "a" of the closure cap in accordance with the invention by way of an axial section of the cap (FIG. 1*a*), a partial axial section (FIG. 2*a*) of the cap screwed on a bottle, and a horizontal section (FIG. 3*a*) along the line A—A in FIG. 1*a;*

Figure 1B:
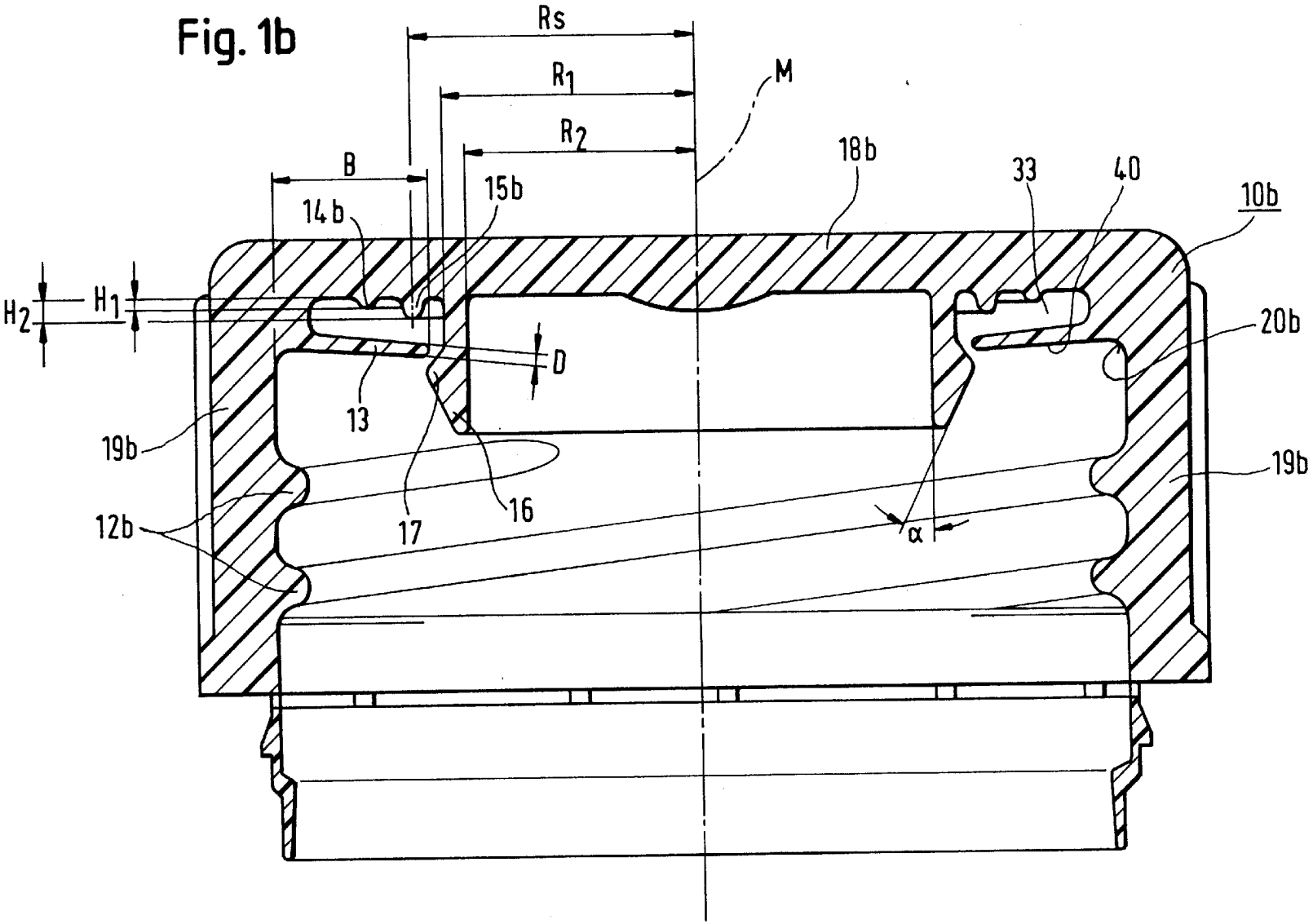
Figure 2B:
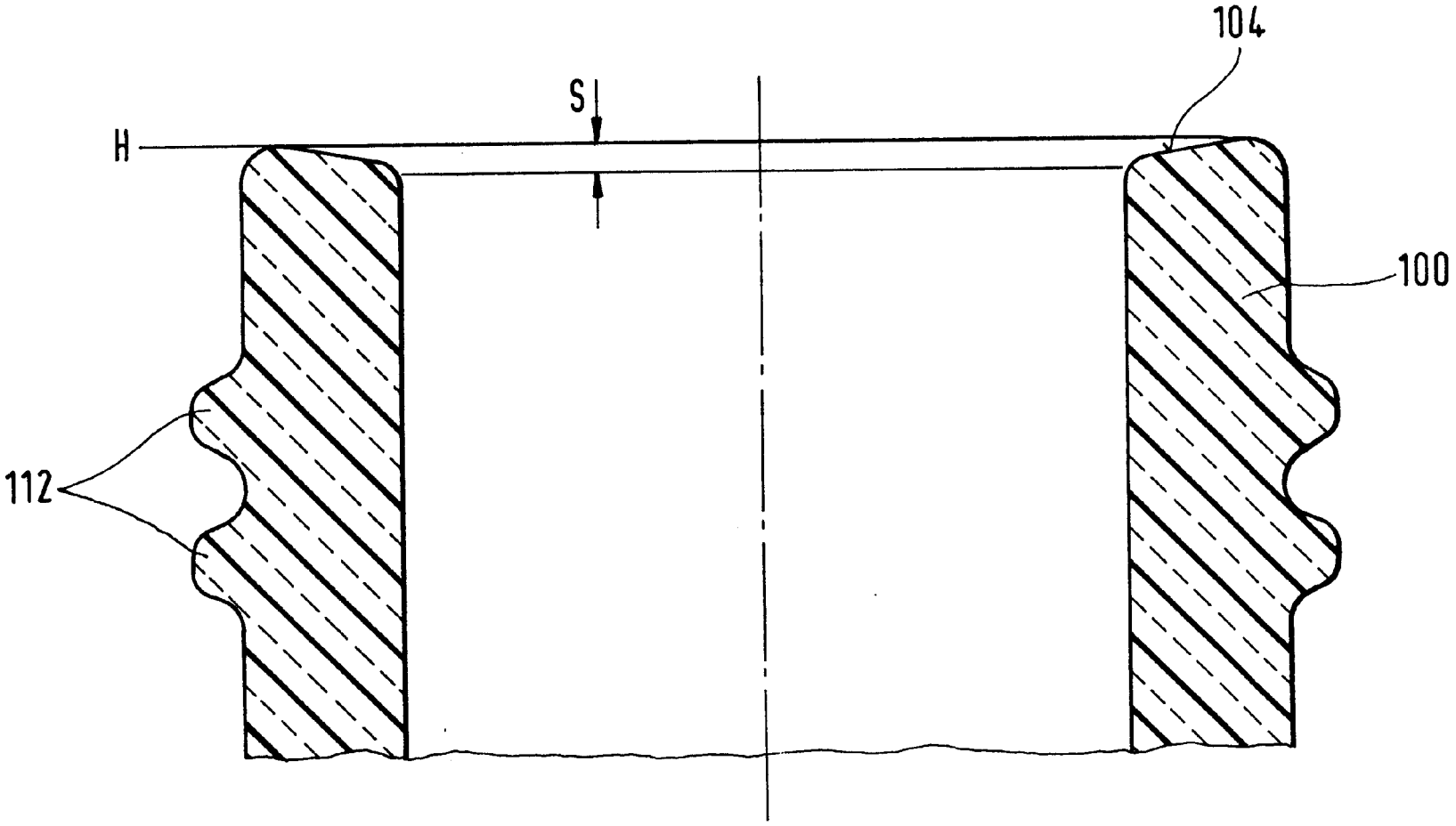
Figure 3B:
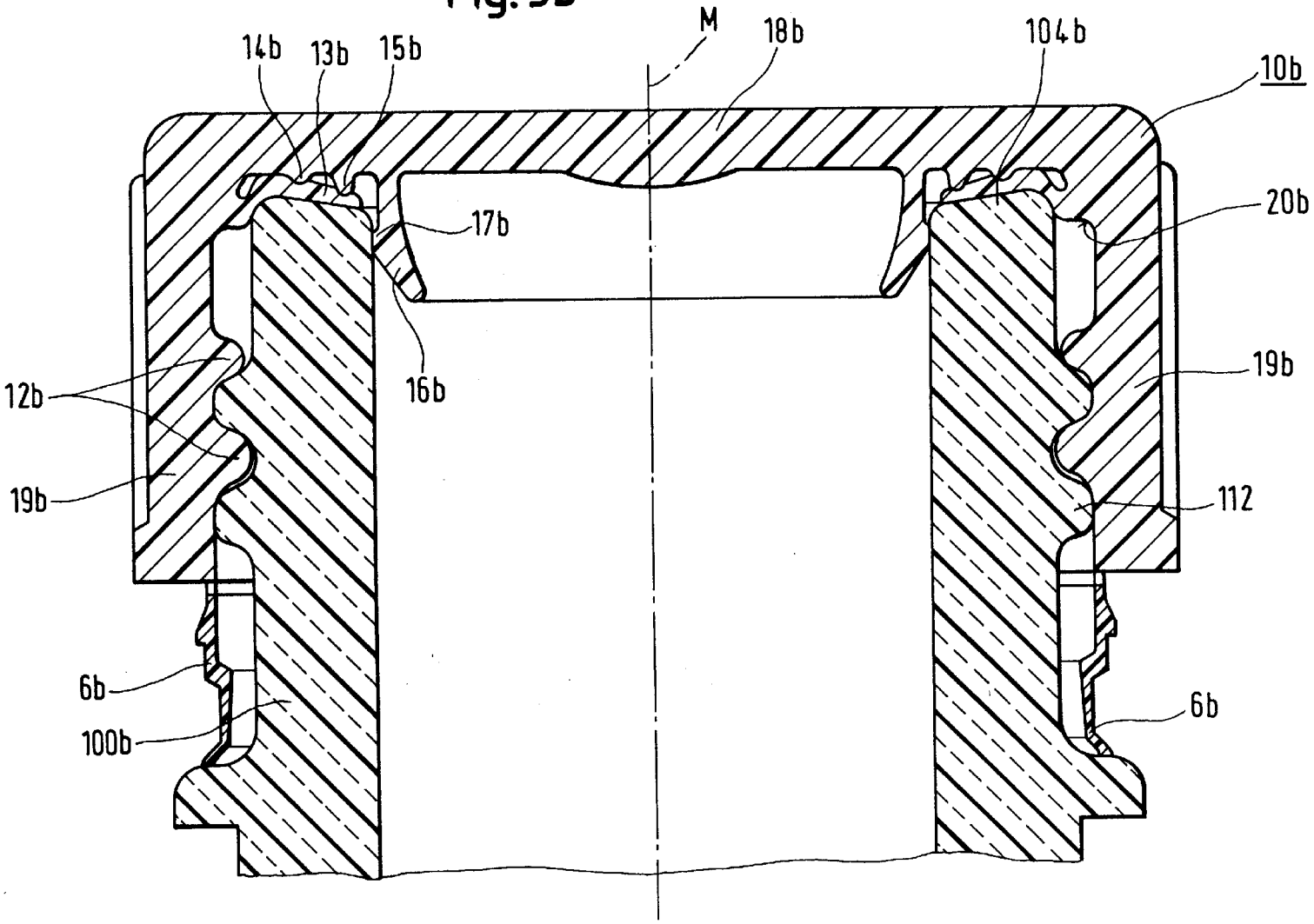
Figure 4:
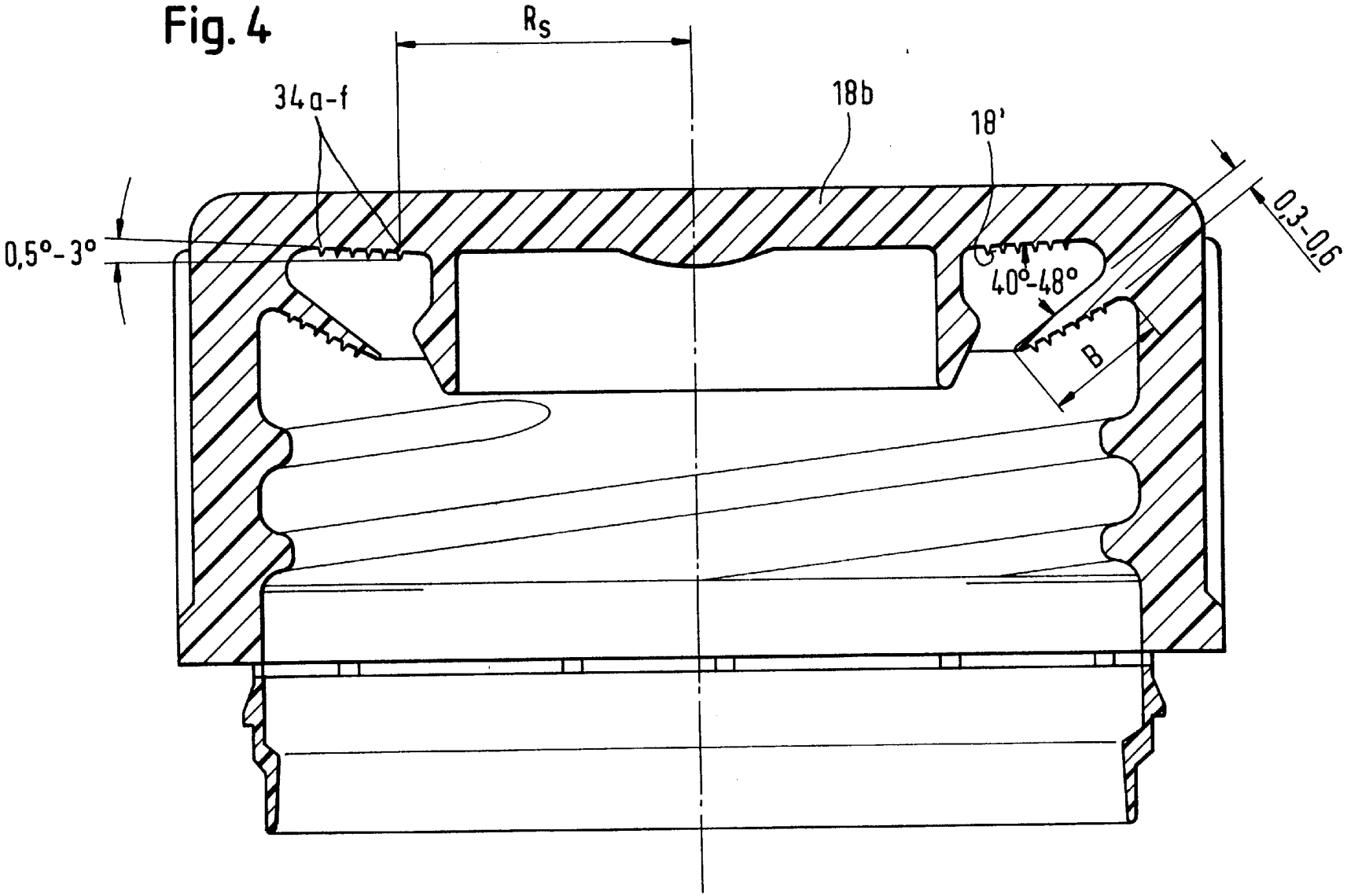

FIGS. 1*b*, 2*b*, 3*b*: An example of embodiment "b" of the closure cap in accordance with the invention by way of an axial section (FIG. 1*b*) in the closed state; and for a container (FIG. 2*b*) to be closed in an axial section (FIG. 3*b*);

FIG. 4: An example of an embodiment "c" of the closure cap in accordance with the invention in axial section.

In the patent drawings, there is presented in FIG. 1 and FIG. 1*a* a preferred example of embodiment of the invention in an axial section. The shape given to the closure cap is accentuated by right-hand hatching whereas the shape given to the bottle neck inside the cap is accentuated by left-hand hatching.

The closure cap is a one-piece cap, i.e. the three sealing lips 8*a*, 10*a*, 15*a* which extend opposite to the rim of the bottle-neck 1, are manufactured in one single process step, as is the guarantee band. In FIG. 1 the closure cap is shown in a state wherein it is screwed firmly upon the bottle neck. The guarantee band 6 which is connected to the body 2, 3, 4 of the closure cap via small bars 55 grips underneath a bulge or projection on the outer side of the bottle neck 1. The separable guarantee band 6 extends far in the downward direction and sits on a supporting collar of the bottle. The supporting collar is used for suspending the container, here a PET-bottle 1, on a transportation device while the container 1 is going to be filled and closed.

Although the fitted guarantee band 6 is relatively soft, it sits according to the invention, nevertheless firmly on the bottle neck and is immediately disrupted when the screw-type cap is going to be opened. The shape given to the plastic closure cap 2 to 7 allows for the first time to respond to the technical requirements which comprise simultaneously simple manufacturing (one-piece closure cap), secure sealing function (soft material for sealing lips), simple manner of opening (easy tearing-off of the guarantee band) and reliable guarantee function (guarantee band resting tightly on the container).

The patent claims 9 and 10 relate to a closure cap, especially for use with reusable PET-bottles having a cap wall provided with an inner thread, a front side which closes the cap wall, and an annular guarantee band fitted on the cap wall and including a splitable predetermined breaking point, with the front wall being provided with a circular inner seal spaced apart from the cap wall and inclined towards the open end, the outer diameter of which being tapered within the region of the free end towards the latter.

Regarding the caps, they are always of the type for being screwed on bottles, in particular for closing so-called reusable bottles. Such type of bottle is used for filling-in beverages of any kind, in which particularly beverages which include carbon dioxide are filled. Consequently, the closure cap used therewith must also withstand the gas pressure developed inside the bottle and thus must close respectively close-up in a gas-tight manner on the bottle and, respectively, relative to the bottle.

Since some time, so-called PET-bottles are also on the market now which are of the reusable plastic type and are offered in particular in a format having a filling volume of 1.5 liters. Because of considerable tolerances associated with these bottles in the region of the bottle mouth, specific problems of sealing exist with said bottles in respect of the closure caps to be used. Consequently, closure caps are required which are subject to special sealing measures. In addition, reference must be made to the fact that the PET-bottles in question have no longer objectionable mouths and threads with multiple use, the more so because these bottles are most often deformed resp. Damaged by the handling of the users and the-fillers.

In order to remedy the problem explained above one has, reviewing the state of the art, had recourse already to a solution, wherein the closure caps are provided with a specific sealing material, at least in the region of the front wall, where the front surface of the bottle mouth comes to rest. To this purpose a preferably soft plastic material is used which differs from the other material—aluminium or also plastic—of the closure cap. Consequently, a one-piece closure cap consisting of different materials, is provided by this measure which is no longer justified in view of the recycling of this kind of parts that is more and more strongly required. Namely, in practice, it is not possible to remove an additional sealing, made of a second material and introduced into the closure cap after use of the closure cap so as to initiate a type of recycling specified to the material. Consequently, with this type of closure caps having different component, the only thing to do is to discard the cap to the domestic garbage. But just this kind of doing shall be avoided in the future, in that this solution known from the practical experience and used for obtaining a gas-tight closure, in particular for returnable PET-bottles is not qualified for implementation, or only in case of extreme need.

In this context and in accordance with the invention it has been perceived that for the purpose of closing a bottle in a gas-tight manner by means of the discussed screwable closure cap a specific configuration of the inner sealing is required. This specific configuration is characterized in that the inner sealing comprises a bulge disposed in the region of the free end and directed towards the cap wall which bulge presses against the inner wall of the bottle when the closure cap is screwed on the bottle. Because of the configuration of the bulge in the region of said free end, and because of the integration of the region, tapering in respect of the outer diameter, in the bulge, the inner wall presses very strongly against the inner wall of the bottle—with the closure cap being screwed upon it—and forms an effective tightening. A gas pressure which builds up inside the bottle is used in quite particularly advantageous manner for pressing the inner seal on the inner wall of the bottle, which bead formed at the free end of the inner seal being pressed with an enormous pressure against the inner wall of the bottle by virtue of the nevertheless considerable distance to the front wall. Because of the relatively deep extension of the inner seal respectively of the bead disposed at the free end into the bottle, a sliding-off of the bead at the bottle mouth is not possible; instead a certain slipping of the bead along the inner wall of the bottle is possible without sacrificing the tightening effect.

Alternatively to the precedingly discussed teaching in accordance with the invention, the invented closure cap can also be characterized by the features of claim 10. According to this claim the inventive closure cap is adapted such that the front wall comprises an inclined first circular wedge seal disposed in the region between the cap wall and the inner seal and descending, at least slightly towards the inner seal. In the framework of this inventive alternative it has been recognized that a sufficiently effective tightening between the closure cap and the bottle to be closed can be implemented in forming between the inner seal and the wall of the cap a seal, called wedge seal because of its wedge-shaped design. This seal, too, is shaped circularly and is bent towards the inner seal by virtue of its inclination towards the inner seal in the course of screwing onto a bottle so that the wedge seal rests fixedly against the bottle in the region of the bottle mouth because of its inherent elasticity and the tension caused by the screwing procedure.

In respect of a particularly effective tightening between the closure cap and the bottle it is advantageous, when the inner seal, in addition to the provision of the wedge seal discussed, before comprises a bulge in the region of the free end and directed to the cap wall, and when this bulge includes the region tapering in respect of its outer diameter. To put it in other terms: the features presented before as being alternative solutions are combined in a particularly advantageous manner, in order to improve the tightening effect efficiently in view of a very high gas pressure inside the bottle.

As to the configuring of the inner sealing it is advantageous when the latter extends approximately straight forward from the side turned away from the cap wall towards and up to the bulge. This means that the inner wall of the inner sealing altogether forms an approximately circular inner surface. On the side facing the cap wall, the inner seal merges into the bulge in an approximately bent manner, i.e. the side of the inner seal facing the cap wall extends in the direction of the cap wall. Starting therefrom the inner seal tapers more or less in respect of its outer diameter in a straight line, whereby a wedge surface is formed which extends from the lower end of the inner seal towards the most outer region of the bulge, by means of which surface the inner seal respectively the bulge of the inner seal is capable of being inserted into the bottle mouth. Because of this wedge-shaped internal design, the inner seal is pressed inwardly along a distance which corresponds approximately to the degree of inclination of the bulge and, as a result of the inherent elasticity and thus of the stress reached at thereby, exerts a considerable pressure on the inner wall of the bottle in the mouth region.

The bulge is advantageously dimensioned such and extends into the cap wall such that the inner sealing respectively the bulge, when being in the screwed-on state presses,—in correspondence with the tolerances of the closure cap on the one hand and of the bottle mouth on the other hand—with a predetermined pressing force against the inner wall of the bottle in the region of the bottle mouth.

The first wege seal already mentined before is positioned and dimensioned in a particularly advantageous manner, such that it serves for resting against the radius of the bottle neck, with the closure cap being in the on-screwed state, i.e. resting along the transition portion into the bottle mouth.

To put it in other terms: during the screwing of the closure cap on the bottle, the first wedge seal is bent towards the front wall and, by means of its proper elasticity and the stress resulting therefrom in the on-screwed state, it presses on the radius of the bottle neck respectively on the transition portion merging into the bottle mouth, i.e. it presses upon the edge existing between the front surface of the bottle mouth and the inner wall of the bottle. When pressure inside the bottle is building up the wedge seal is pressed even stronger against the bottle radius so that by virtue of the inner pressure the tightening effect is again increased. The same is true for the inner sealing mentioned before in detail which, also by the pressure building up inside the bottle beyond the pressure reached, is pressed i.e. enhanced, by the stress specific to the material against the inner wall of the bottle.

Concretely speaking, the first wedge seal may have different shapes; it may for instance taper off up to the free end and having essentially flat surfaces. Also, the surfaces on both sides of the first wedge seal may be shaped concavely or convexly. A rounding of the free end of the first wedge seal is possible likewise.

In order to increase again the tightening effect of the closure cap in accordance with the invention it is still more advantageous when there is provided a second circular wedge seal in the region between the cap wall and the inner seal, preferentially in the transitional region between the cap wall and the front wall which second seal extends from the front wall respectively the cap wall and is inclined at least slightly towards the inner seal. This second wedge seal may be positioned and dimensioned such that, in the screwed-on state, it serves for biased resting on the front surface of the bottle mouth. The second wedge seal is therefore bent in the course of screwing-on of the closure cap relative to the front wall, like in the case of the first wedge seal, whereby an important pressing force on the bottle, more exactly on the front surface of the bottle mouth is built-up by the inherent elasticity of the second wedge seal. The second wedge seal, too, may taper-off and have essentially flat surfaces, with these surfaces on both sides of the second wedge seal may be shaped concavely or convexly, too. The comments given in respect of the first wedge seal are valid also for the second wedge seal so that further consideration on this point is no longer necessary.

Finally, in respect of an improvement of the tightening effect of the closure cap in accordance with the invention the cap wall could comprise, preferentially in the upper region, i.e. in the region shortly before the transition to the front wall, a circular seal for resting on the outer wall of the bottle, which front wall would extend approximately radially, respectively inwards. The seal may be a cord packing or a sealing ring, with this seal being, by preference, an integral part of the closure cap. The seal may be rounded towards the inner side in the sense of a tightening bulge and dimensioned such that it rests on the outer wall of the bottle in a pretensioned state when being screwed on the bottle.

The preceding discussions concerning different tightening means disposed between the closure cap and the bottle demonstrate clearly that a combination of the sealing means respectively the seals explained above leads to a kind of multi-barrier system in regard to the tightening of the bottle. In such a system all of the seals with the exception of the seals associated with the cap wall, are configured resp. arranged such that they exhibit an inceased sealing effect with rising inner pressure, since they are going to rest against the bottle wall respectively the front wall of the bottle as a result of the rising inner pressure.

Having said this, it is of a very particular advantage in view of a secure and perceivable closing of the bottle, when in combination therewith the guarantee band is provided. This guarantee band connects to the cap wall on the side turned away from the front wall and is provided with a first predetermined breaking point. Such layout of the guarantee band is, however, problematic in so far as in the course of opening the bottle, i.e. when unscrewing the closure cap, the guarantee band is broken in a first step and is then torn-off entirely by numerous users. After use, i.e. after emptying the bottle, this entirely torn-off guarantee band enters pretty often into the interior part of the bottle, from where it can be extracted only with difficulty because of its bent shape. The guarantee bands which have entered the bottle cannot be washed out of it. So-called bottle inspection machines do not detect these bands so that pretty often such former—used—guarantee bands enter again into a beverage filled in the reusable bottle. Complaints are preprogrammed.

Consequently, it is of a very particular advantage when the guarantee band here discussed is provided with a second predetermined breaking point. This second predetermined breaking point could be disposed in such a manner that it is juxtaposed more or less to the first predetermined breaking point so that the guarantee band is at the time of tearing-up—subsequently to a tearing-up of the first predetermined breaking point—, split into two halves of approximately equal lengths as a result of the tearing-up of the second predetermined breaking point. In proceeding this way the guarantee band cannot be torn-off in one piece but exclusively in two pieces, namely in two short pieces. These two pieces stemming from the guarantee band as a whole can be washed out of the bottle via the relatively narrow bottle neck so that the afore mentioned problem is solved.

In view of a simple manner of manufacturing the closure cap is made in one piece. Polyethylene is particularly fitted to these purposes, the more so because this resin can be subjected to a recycling process without further a doing. Finally, it is essential in respect of the closure cap according to the invention: that the cap can be made exclusively of one and the same material; that predetermined sealings are required; and that no combinations of materials in respect of the front wall, the cap wall and inside the closure cap are required.

FIGS. 1*a*, 2*a* and 3*a* show in common one example of embodiment a of a closure cap according to the invention for a reusable PET-bottle 1 comprising a cap wall provided with an inner thread 2, a front wall 4 closing the cap wall 3, and a circular guarantee band 6, 6*a* connecting to the cap wall 3 and capable of being torn up at a predetermined breaking point 5, with the front wall 4 comprising a circular inner seal 7, 7*a* which is spaced apart from the cap wall 3 and inclines towards the open end, with the outer diameter of the seal becoming smaller in the region of the free end towards this end.

According to the invention the inner seal 7*a* includes a bulge 8*a* which is directed towards the cap wall 3*a* and is formed in the region of the free end. The bulge 8*a* comprises the region 9*a* which becomes smaller in outer diameter.

The FIGS. 1*a* and 2*a* also show that the front wall is provided with a first circular wedge seal 10*a* which projects from the front wall 4 and inclines towards the inner seal 7.

The inner seal 7 extends along the side turned away from the cap wall 3 approximately linearly up to the bulge 8. On the side facing cap wall 3, the inner seal 7 extends approximately in an arched manner up to the bulge 8, i.e. it merges into the bulge 8 and taper-off therefrom again linearly in respect of its diameter. The bulge 8 is dimensioned respectively extended towards the cap wall 3 such that the inner seal 7 respectively the bulge 8 presses against the inner wall 11 of the bottle in the region of the bottle mouth 12*a* in applying a predetermined pressure force, when being in the screwed-on state.

FIG. 2*a* shows clearly that the first wedge seal 10*a* is positioned and dimensioned in such a manner that in the screwed-on state it serves for providing a preloaded facing on the inner edge 13*a* of the bottle neck 14*a* respectively in the transition passing into the bottle mouth 12*a*. This first wedge seal 10*a* extends to the free end in tapering-off and has essentially flat surfaces.

The FIGS. 1*a* and 2*a* show in addition clearly that in the region between the cap wall 3 and the inner seal 7 forming the transition between the cap wall 3 and the front wall 4, a second circular wedge seal 15, 15*a* is provided which projects from the front wall 4 respectively the cap wall 3 and inclines towards the inner sealing 7. The second wedge seal

15, 15*a* is positioned and dimensioned in accordance with the presentation shown in FIG. 2*a* such that in the screwed-on state it serves for providing a preloaded facing on the front surface 16*a* of the bottle mouth 12*a*. In addition, the second wedge seal 15*a* is made tapering towards the free end and having flat surfaces.

The FIGS. 1*a* and 2*a* additionally show that the cap wall 3 in the upper region, i.e. in the region shortly before the transition to the front wall comprises a circular seal 17*a* projecting approximately radially respectively towards the inner side and serving for resting on the outer wall 18*a* of the bottle. This seal 17*a* is rounded in the sense of a tightening bulge towards the inner side, i.e. towards the outer wall 18*a* of the bottle. In accordance with FIG. 2*a*, the seal 17 is tapered such that it rests against the outer wall 18*a* of the bottle when being in the screwed-on and preloaded state.

Finally, the FIGS. 1*a* and 3*a* show in common that the guarantee band 6, 6*a* includes a second predetermined breaking point 19*a*. The second predetermined breaking point 19*a* lies opposite to the first predetermined breaking point 5 so that the guarantee band 6, in tearing it up—subsequently to the tearing-up in the first predetermined breaking point 5—is separable into two halves 20, 21 of approximately the same length, by way of tearing-up the second predetermined breaking point 19*a*.

Finally, it should be accentuated that the closure cap is made entirely in one piece and consists of plastic, namely polyethylane.

The following discussions of the object of the application relates to closure caps for closing GDB-beverage bottles, in order to keep the discussion easy to survey. However, attention is drawn expressively to the fact that the present invention is not limited to closure caps for GDB-beverage bottles but that it is applicable to any type of container whatsoever, as for instance to food containers (so-called Tupperware) likewise. Also, the closure cap according to the invention can be used as well for reusable (MW) bottles as well as for single-use bottles (EW) made of the material PET:

Closure caps, by means of which beverage bottles or similar containers can be closed, must respond to different requirements. On the one hand the sealing of the beverage bottle respectively the container must be obtained in such a manner that the beverage contained therein cannot leak out of the closed respectively sealed container. If the containers to be sealed are bottles which contain liquids, the conditions are determined by the viscosity of the liquid. If the beverages contained in the bottles are mixed up with a pressurized gas as for instance carbon dioxide, the sealing must also be also gas-tight in order to prevent the gas from leaking out of the bottle.

Explained in detail, the sealing in accordance with the example of embodiment "b" is obtained by providing an ondulatorily ribbed structure which presses the sealing material pointingly against the upper edge of the container, whereby a sealing zone is established within which the sealing means is pressed against the upper edge of the container with high pressure. The structure in accordance with patent claim 24 allows for a controlled positioning of the sealing lip on the container edge subjected to a high pressure of application. This closing process which leads to a very effective tightening is enabled without complicating the closure cap unnecessarily.

Hereafter, the example of embodiment "b" of the present invention is explained in more detail, with reference being made to the FIGS. 1*b*, 2*b* and 3*b*.

In FIG. 1*b* there is shown a closure cap for removably closing a bottle according to a type of embodiment of the present invention which is considered at present to be a preferred one at a time. The embodiment described hereafter in detail relates to a screw closure for closing a bottle which may contain a liquid mixed with carbon dioxide. As has already been mentioned before attention is drawn to the fact that the present invention is not limited to screw closures for bottles. Alternative embodiments relate for instance cans which are suited for storing/freezing of food, or to preserving jars, but also to closure caps of containers which are not used in the food stuff sector, as for instance paint buckets.

In FIG. 1*b* there is shown a closure cap in its initial form in a sectional view. The closure cap consists of a cap body 10*b* which comprises an upper top part 18*b* and an essentially cylindrical side part 19*b*. The side part 19*b* extends essentially in the vertical direction from the plane of the top part 18*b*. According to the embodiment shown in FIG. 1*b*, the transition from the top part 18*b* to the cylindrical side part 19*b* is not abrupt (sharp edged) but by the intermediary of a rounded transient portion 20*b*. Attention is drawn to the point that in the depicted embodiment the ceiling part 18*b*, the side part 19*b* and the transition portion 20*b* are not separate elements but instead form the cap body 10*b* in common.

A screw thread 12*b* is formed on the side part 19*b* which serves as a closure mechanisms, by means of which the closure cap 10*b* is fastened on the container to be closed. The screw thread 12*b* cooperates with a corresponding pairing screw thread 112 (see FIG. 2*b*) on the bottle 100. It is expressively referred to the point that the screw thread 12*b* does not represent the only possible closure mechanism for the container to be closed. All sorts of other closure mechanisms, per se known, can also be used as for instance shackle closures, noses respectively shoulders which engage recesses, etc.

As can be seen from FIG. 1*b* a tightening means in the form of a radially circular sealing lip 13, 13*b* is provided inside on the side part 20*b* in accordance with a preferred embodiment of the present invention. The sealing lip 13 has an elongated wedged shape. In the idle state (i.e. in the state wherein the closure cap does not close a container) the sealing lip 13 extends from the transient portion 20*b* in a nearly horizontal plane, having however, by preference, a slight inclination towards the center point of the closure cap. In a particularly preferred embodiment the inclination lies between 41° and 48° versus the horizontal plane, in order to ease the extraction from the mould (see FIG. 4). The width B of the sealing lip 13 is preferably chosen such that, in the closed state, the inner end of the sealing lip 13 closes essentially flush with the upper edge 104 of the bottle (see FIG. 3*b*). In a particularly preferred example of embodiment (see FIG. 4) the width B lies in the range between 3.8 and 4.5 cm. In using these values, the entire upper edge 104 of the bottle 100 is covered essentially completely by the sealing lip 13 which extends circularly inside the cap body 10*b*. The wedge-shaped, elongated, thin sealing lip 13 adapts, by its profile, to different bottle necks, when, in the course of the closing procedure, normal torques are exerted on the closure cap. In particular, an adaption in profile takes place at the upper edge 104 of the bottle neck as well outside above as inside above. The profile of the sealing lip 13 is adaptable to any radius of curvature. The bottle neck of a reusable bottle is shorter by about 20.7 mm, which is smaller than the inner diameter 21.6 mm of a single-use bottle. In both cases the sealing lip 13 lays itself also inwards into the bottle neck. In the end, the closure cap in accordance with the invention is sitting tightly on the bottle, notwithstanding all imaginable environmental conditions.

The inclination described above of the sealing lip 13 in its idle position is adapted to the inclination of the upper surface 104 of the bottle 100 in relation to the horizontal plane, as can be seen in detail in FIG. 2*b*. According to this Figure, the upper edge 104 of the bottle 100 has an inclination (here magnified for better illustration) versus the horizontal plane H which is indicated by S. Notice is given to the fact that different layouts of the respective surface 104 can be selected, depending upon the various containers. According to the teaching of the invention the inclination respectively the shaping of the sealing lip 13 is adapted to the container to be closed, respectively. In order to achieve the success in accordance with the invention, the provision of the sealing lip 13 with a distinct thickness profile indicated by the reference character D in FIG. 1*b* is of particular importance. Extensive tests of comparison in which the tightening behavior of the closure cap fitted with sealing lips different in thickness has been examined, have shown that the sealing lip 13 has, preferably at its base, a thickness of 3/10 mm to 7/10 mm, and that it should have a thickness at its tip of not more than 5/10 mm and not less than 2/10 mm, and in the case of a particularly preferrred embodiment the values range between 2/10 mm and 4/10 mm. These values have proven to be particularly advantageous for application in GDB-glass bottles made of the conventional plastic materials for the cap body 10*b*. With other closure caps designed for closing larger or smaller containers, correspondingly scaled values apply.

In addition, the sealing lip 13 has a specific scale-like structure (FIG. 4) which cooperates with the unevennesses on the upper edge 104 of the bottle 100, in order to cause a better tightening of the bottle.

The sealing means in a preferred embodiment is disposed such that a chamber 33 is brought about between the top part 18*b* and the side part 19*b* of the closure cap and the thin wedge-like sealing lip, that is, as seen from the sealing lip, above to the side. This chamber 33 provides play for different bottle neck diameters and supports a secure tightening of the respective container.

In FIG. 4 there is shown an additional, particularly preferred embodiment of the closure cap in which the sealing means has a wave-like structure on the inner surface 18 in accordance with the inventive teaching, with a number of concentrically arranged annular shoulders 34*a–f* encircling the top part 18*b*. In addition, the inner surface 18 of the closure cap has an inclination of 0.5° to 3° relative to the horizontal plane and it is ondulatorily ribbed, as can be seen in FIG. 4.These shoulders 34 are disposed in such a manner that the sealing lip 13 rests upon them in the closed state and is pressed by them against the upper edge 104 of the bottle 100. The distance between the shoulder 34*a–f* is preferentially chosen such that all of the shoulder lie on the upper edge 104 of the bottle 100; in other words, the radius Rs of the concentrically encircling shoulders is preferentially chosen such that the most outer shoulder 34*a* (FIG. 4) respectively 14*b* (FIG. 1*b*) neighbour the outer edge of the bottle 100, whereas the most inner shoulder 34*f* (FIG. 4) respectively 15*b* (FIG. 1*b*) extends adjacent to the inner edge of the bottle 100. According to a particularly preferred embodiment, the radius Rs of the concentrically encircling shoulders 34*a–f* ranges between 16.5 mm to 18.5 mm and the radius Rs of the concentrically encircling shoulder 15*b* amounts to about 17.5 mm.

As can be seen particularly from FIG. 1*b*, the shoulders 14*b* and 15*b* have different heights H1, H2. According to the invention, the difference in the heights H2–H1 is chosen such that in taking into account the slope S of the bottle surface 104 (see FIG. 2*b*), an even pressure upon the upper edge 104 of the bottle 100 in the closed state arises. As can be seen in particular from FIG. 4 the heights of the shoulders 34 in this embodiment are chosen in accordance with the invention in such a manner that the sealing means so to say nestles against the upper edge 104 of the bottle 100 in the closed state and tightens the latter safely. The shoulders 34*a–f* in this embodiment as well as the two shoulders 14*b* and 15*b* of the example of embodiment shown in FIG. 1*b* exert an even pressure upon the sealing lip which is comparatively high because of the small effective surface of the shoulders. In cooperation with the scaly structure provided on the lower side of the sealing lip and of the unevennesses on the upper edge 104 of the bottle 100, a secure and reliable sealing is thus obtained.

According to a further preferred embodiment of the present invention there is provided also and in addition to the sealing lip an elastic lamella 16, 16*b* which extends vertically from the top part 18*b* and which projects in the idle state vertically (see FIG. 1*b*). The sealing lamella 16 extends also concentrically to the central line M of the cap body, with the inner edge having a radius $R_1$ and the outer edge having a radius $R_2$. The radii $R_1$ and $R_2$ are chosen such that the sealing lamella 16 is directly adjacent to the sealing lip in the idle state. According to a particularly preferred embodiment the length of the radius $R_1$ is 15.4 mm and the one of $R_2$ is 11.8 mm.

In accordance with the inventive teaching the sealing lamella 16 fitted with a shoulder 17, 17*b*, the highest point of which, in the idle state of the cap body 10*b*, is located on a cylindrical surface, together with the free end of the sealing lip 13. The radius of the shoulder 17 is preferably 0.25 mm and is chosen such that the sealing lamella 16 extends from the highest point of the shoulder 17 to the tip of the lamella 16 by an angle $\alpha$. Numerous comparative tests have shown that the angle a should not exceed 35° and not remain below 25°, and that it should amount to 28° in accordance with a particularly preferred embodiment. These values have turned out to be particularly advantageous for glass bottles to be closed in using the conventional plastic materials for the cap body 10*b*. For use with other closure caps which must close greater or smaller containers, correspondingly scaled values apply.

As can be seen in detail from FIG. 3*b*, the shoulder 17*b* of the sealing lamella 16*b* cooperates with the inner side of the bottle 100 in the closed state, with the sealing lamella 16*b* being turned away from its idle position and arched towards the inside of the bottle acting upon the closure mechanism 12*b*. Exactly as with the shoulders 14*b* resp. 34*a–f* a comparatively high sealing pressure is obtained by the small effective surface of the sealing lamella 16*b* (which surface is predetermined essentially bay the knoll area of the shoulder 17*b*) which pressure is defined by the righting moment of the deflected sealing lamella 16*b*.

The closure cap in accordance with the invention can be manufactured from different materials. If the sealing means 11 (together with the shoulder 14*b* respectively 34*a–f* and the elastic lamella 16*b*) is provided as an integral component of the closure cap, polyethylene is particularly well-suited as a cap material.

What is claimed is:

1. A one piece plastic closure cap (2, 3, 4, 5, 6, 7, 12, 18, 19, 5, 6, 16) for a container (1; 100) having a closure mechanism (2; 12) for disengageably fastening the closure cap on an opening of the container wherein the container has a bulge or projection on the container, a supporting collar to suspend the container during filling and a neck which has an edge_at the opening of the container comprising:

a) a removable guarantee band (6) wherein the removable guarantee band has a funnel shaped or bell shaped prolongation at a free end and has a height in the direction of the central axis of the closure cap which extends beyond the bulge or projection to said supporting collar so that when fastened to the container the funnel shaped or bell shaped prolongation is capable of sitting on the supporting collar in a non under grippable manner and the removable guarantee band is pressed against the lower side of the bulge or projection, b) sealing lips having a inner seal which has a wedge or funnel shaped outer surface which is capable of resting on the inside surface of the container neck in a pressing manner; and c) a plastic material for the construction of the closure cap having the property of being sufficiently hard to function as a guarantee band and at the same time soft for the sealing lips to seal.

2. Closure cap according to claim 1, characterized by a construction which is formed in one piece, with the guarantee band (6) and the sealing lips (7; 16) being included.

3. Closure cap according to claim 1 wherein the plastic material is polyethylene.

4. Closure cap according to claim 1, characterized in that the closure cap, including the detachable guarantee band (5, 6), has a height in the direction of the central axis of the closure cap greater than 20 mm, in particular of about 23.5 mm.

5. Closure cap according to claim 1 characterized in that the edge of the guarantee band (6) is capable of sitting on said supporting collar like a standing clock.

6. Closure cap according to claim 1, characterized in that the cap wall (3*a*) in the upper region, i.e. in the region shortly before the transition to the front wall (4*a*), comprises a circular seal (17*a*) which projects approximately radially respectively towards the inside, for resting on the outer wall (18*a*) of the bottle.

7. Closure cap according to claim 6, characterized in that the seal (17*a*) is rounded towards the inside in the sense of a bulge.

8. Closure cap according to claim 6, characterized in that the seal (17*a*) is dimensioned such that it rests in the screwed-on state and is biased against the outer wall (18*a*) of the bottle.

9. Closure cap according to claim 1 in combination with a container.

10. Closure cap according to claim 9 wherein the container is a used or new bottle.

11. Closure cap according to claim 10 characterized in that the container is a plastic bottle (1; 100).

12. Closure cap according to claim 11 characterized in that the container is made from a PET or a PEN material.

13. Closure cap according to the claim 1, having a cap wall (3*a*) with an inner thread (2*a*), a front wall (4*a*) which closes the cap wall, and an annular guarantee band (6*a*) fitted on the cap wall (3*a*) and including a disruptable predetermined breaking point (5*a*), with the front wall (4*a*) being provided with a circular inner seal (7*a*) spaced apart from the cap wall (3*a*) and inclined towards the open end, the outer diameter of which is tapered within region (9*a*) of the free end towards the latter, with the front wall (4*a*) comprising in the region between the cap wall (3*a*) and the inner seal (7*a*) a circular wedge seal (10*a*) which projects from the front wall (4*a*), at least slightly inclined, towards the inner seal (7*a*).

14. Closure cap according to claim 13 characterized in that first wedge seal (10*a*) is positioned and dimensioned such that, when it the screwed on states, it serves for biased application on the radius of the bottle neck (14*a*) which is in the transition of the region leading on to the bottle mouth (12*a*).

15. Closure cap according to claim 14, characterized in that the first wedge seal (10*a*) tapers towards the free end, in having essentially flat surfaces.

16. Closure cap according to claim 13, characterized in that the inner seal (7*a*) comprises a bulge (8*a*) directed toward the cap wall (3*a*) and formed at the area of the free end, and that the bulge (8*a*) includes the region (9*a*) which tapers in respect of its diameter.

17. Closure cap according to claim 16, characterized in that the bulge (8*a*) is dimensioned such, respectively is directed to the cap wall (3*a*) such that the inner seal (7*a*) respectively the bulge (8*a*) presses against the inner wall (11*a*) of the bottle in the region of the bottle mouth (12*a*), when being in the screwed-on state.

18. Closure cap according to claim 1, anyone of the preceding claims, having a cap wall (3*a*) with an inner thread (2*a*), a front wall (4*a*) which closes the cap wall, and an annular guarantee band (6*a*) fitted on the cap wall (3*a*) and including a separable predetermined breaking point (5*a*) with the front wall (4*a*) being provided with a circular inner seal (7*a*)spaced apart from the cap wall (3*a*) and inclined towards the open end, the outer diameter of which is tapered within the region (9*a*) of the free end towards the latter, with the inner seal (7*a*) comprising a bulge (8*a*) and formed in the region of the free end and directed to the cap wall (3*a*), and the bulge (8*a*) including the region (9*a*) which tapers in respect of its outer diameter.

19. Closure cap according to claim 18, characterized in that the inner seal (7*a*) on the side turned away from the cap wall (3*a*) extends approximately linearly up to the bulge (8*a*) and merges with- the bulge (8*a*) on the side which faces the cap wall (3*a*) in an approximately arcuate manner and tapers from thereon again approximately linearly in respect of the outer diameter.

20. Closure cap according to claim 18, characterized in that in the region between the cap wall (3*a*) and the inner seal (7*a*), in the transition portion between the cap wall (3*a*) and the front wall (4*a*), a second circular inclined wedge seal (15*a*) is provided, which projects from the front wall (4*a*) respectively from the cap wall (3*a*) at least slightly inclined towards the inner seal (7*a*).

21. Closure cap according to claim 20, characterized in that the second wedge seal (15*a*) is positioned and dimensioned such that it serves, when being in the screwed-on state, for biased application against the front surface (16*a*) of the bottle mouth (12*a*).

22. Closure cap according to claim 20, characterized in that the second wedge seal (15*a*) tapers toward the free end in having essentially flat surfaces.

23. Closure cap according to claim 18, characterized in that the guarantee band (6*a*) includes a second predetermined breaking point (19*a*).

24. Closure cap according to claim 23, characterized in that the second predetermined breaking point (19*a*) lies opposite to the first predetermined breaking point (5) so that the guarantee band (6) in tearing it up—subsequently to the tearing-up of the first predetermined breaking point (5*a*)—is separable into two halves (20, 21) of approximately the same length, by virtue of a tearing-up of the second predetermined breaking point (19*a*).

25. Closure cap according to claim 1, having a tightening means which cooperates with the upper edge (104*b*) of the container (100*b*), in order to tighten it when closing the closure mechanism (12*b*), with the tightening means comprising a wedge-shaped sealing lip (13*b*) having a width (B) which is essentially greater than the thickness of the upper edge (104*b*) of the container (100*b*) and with the inner surface of the top part (18*b*) at the location where it cooperates with the sealing lip (13*b*), having an ondulatorily or wavelike ribbed structure (14*b*, 15*b*; 34*a–f*).

26. Closure cap according to claim 25, characterized in that, in addition, an elastic lamella (16*b*) is provided which extends from the inner side of the cap body (10*b*) essentially vertically into the opening of the container (100*b*), and which has a shoulder (17*b*), which rests on the container (100*b*), when the closure mechanism (12*b*) is actuated.

27. Closure cap according to claim 25, characterized in that the cap body (10*b*) consists of the top part (18*b*) and a side part (19*b*) which extends vertically to the top part (18*b*); and that the sealing lip (13*b*) is fastened inside to a transition part (20*b*) which connects the top part (18*b*) to the side part (19*b*).

28. Closure cap according to claim 25, characterized in that the top part (18*b*) has an inclination of 0.50 to 3°.

29. Closure cap according to claim 25, with the sealing lip (13*b*) being formed integral with the cap body (10*b*).

30. Closure cap according to claim 25, characterized in that the closure mechanism is a screw-on mechanism.

31. Closure cap according to claim 25, characterized in that the closure mechanism is a clip-lock mechanism.

32. Closure cap according to claim 25, characterized in that the thickness (D) of the sealing lip (13*b*) lies in the range between 2/10 mm and 4/10 mm at its tip, and between 3/10 mm and 7/10 mm at its base.

33. Closure cap according claim 25, characterized in that the sealing lip (13*b*) is inclined by 41° to 48° relative to the horizontal plane.

34. Closure cap according to claim 25, characterized in that a chamber (33) is arranged between the top part (18*b*) and the side part (19*b*) of the closure cap and the thin, wedge-shaped sealing lip (13*b*), in order to provide space for accomodation.

35. Closure cap according to claim 25, characterized in that the inner edge of the sealing lamella (16*b*), which provides a connection between the tip of the sealing lamella (16*b*) and the shoulder (17*b*), spans an angle ($\alpha$) with respect to the outer edge lying in the range of 25° to 35°.

36. Closure cap according to claim 25, characterized in that the inner edge of the sealing lamella (16*b*), which establishes a connection with the tip of the sealing lamella (16*b*) and the shoulder (17*b*), includes an angle ($\alpha$) of 28°.

37. Closure cap according to claim 25 characterized in that sealing lip (13) is provided on its surface with a scaling like structure.

* * * * *